US007357297B2

(12) United States Patent
Crowson

(10) Patent No.: US 7,357,297 B2
(45) Date of Patent: Apr. 15, 2008

(54) DEVICE FOR REMOTELY INDICATING THE OPENING OF A MAILBOX DOOR

(76) Inventor: Ray E. Crowson, 110 Brown Dr., Texarkana, TX (US) 75501

( * ) Notice: Subject to any disclaimer, the term of this patent is extended or adjusted under 35 U.S.C. 154(b) by 0 days.

(21) Appl. No.: 11/705,928

(22) Filed: Feb. 14, 2007

(65) Prior Publication Data

US 2007/0210146 A1 Sep. 13, 2007

Related U.S. Application Data

(60) Provisional application No. 60/778,470, filed on Mar. 3, 2006.

(51) Int. Cl.
*A47G 29/12* (2006.01)

(52) U.S. Cl. ..... 232/35

(58) Field of Classification Search ..... 232/35, 232/34, 17; D99/29–32, 43
See application file for complete search history.

(56) References Cited

U.S. PATENT DOCUMENTS

| | | | | | |
|---|---|---|---|---|---|
| 2,428,423 | A | * | 10/1947 | Hurban | 232/35 |
| 2,433,940 | A | * | 1/1948 | Weaver | 232/35 |
| 2,483,992 | A | * | 10/1949 | Young | 232/35 |
| 2,730,298 | A | * | 1/1956 | Haserodt | 232/35 |
| 2,874,895 | A | * | 2/1959 | Opp et al. | 232/35 |
| 3,102,684 | A | * | 9/1963 | Eging | 232/35 |
| 3,338,511 | A | * | 8/1967 | Cvar | 232/35 |
| 3,596,631 | A | * | 8/1971 | Sutton | 232/35 |
| 3,866,823 | A | * | 2/1975 | Grayson | 232/35 |
| 4,000,847 | A | * | 1/1977 | Duis | 232/35 |
| 4,138,056 | A | * | 2/1979 | Sherrill | 232/35 |
| 4,171,086 | A | * | 10/1979 | Hudson | 232/35 |
| 4,473,182 | A | * | 9/1984 | Dion | 232/35 |
| 4,491,268 | A | * | 1/1985 | Faulkingham | 232/35 |
| 4,524,905 | A | * | 6/1985 | Crist | 232/35 |
| 4,702,411 | A | * | 10/1987 | Yager | 232/35 |
| 4,711,391 | A | * | 12/1987 | Roge et al. | 232/35 |
| 4,798,326 | A | * | 1/1989 | Kirry et al. | 232/34 |
| 4,840,307 | A | * | 6/1989 | Hartman | 232/35 |
| 5,094,386 | A | * | 3/1992 | Tabacco | 232/35 |
| 5,427,311 | A | * | 6/1995 | Kachmar | 232/35 |
| 5,497,940 | A | * | 3/1996 | Vogt | 232/35 |
| 6,065,671 | A | * | 5/2000 | Stepleton | 232/35 |

* cited by examiner

*Primary Examiner*—William L. Miller
(74) *Attorney, Agent, or Firm*—Ronald B. Sefrna

(57) ABSTRACT

A device for providing a positive indication that the door of a rural-type mailbox has been opened includes an elongate indicator strip with a first end and a second end, formed of a flexible, shape-retentive material with a spring bias toward a curved rest configuration. The indicator strip is connected at its first end to a mailbox such that the curved strip extends outward from the mailbox when in rest configuration, and may be flattened against the mailbox with the second end of the indicator confined between the sidewall of the mailbox and the lip of the closure door to hold the indicator against the mailbox in a cocked position. When the mailbox door is opened the second end of the indicator is released to assume its outwardly extending rest position and provide a visual indication that the mailbox has been opened.

18 Claims, 7 Drawing Sheets

DEVICE FOR REMOTELY INDICATING THE OPENING OF A MAILBOX DOOR

RELATED APPLICATION DATA

This application claims the benefit of U.S. Provisional Patent Application Ser. No. 60/778,470, filed Mar. 3, 2006.

FIELD OF THE INVENTION

The present invention generally relates to rural-type mailboxes and indicators, and in its preferred embodiments more specifically relates to an indicator flag device for remotely signaling that the mailbox has been opened, indicating the likely presence of delivered mail.

BACKGROUND

Mailboxes used in rural settings and in many suburban settings are formed as hollow box-like structures, typically with a curved top, and with a door at one or sometimes both ends of the box for access to the interior. These mailboxes include a flag that is pivotally mounted on one side of the mailbox to indicate to a mail carrier that the mail customer has placed outgoing mail in the box, so the carrier will open the box to remove the outgoing mail even if the carrier has no mail to be delivered to that box. When the outgoing mail is removed the carrier lowers the flag. If a mail customer has placed outgoing mail in the box and raised the flag to signal the carrier, the lowering of the flag by the carrier provides a visual indication to the owner of that mailbox that the mail carrier has opened the mailbox, and that mail may have been delivered.

When a mail customer has no outgoing mail, however, there may be no indication to the customer that the carrier has completed that portion of his or her route. Even if the carrier has completed that portion of the route, the customer has no indication that the carrier opened the customer's mailbox. Therefore, the customer must open the mailbox and check for delivered mail. In many instances a customer's mailbox may be a significant distance from, e.g., his or her residence, and a trip to the mailbox can be quite an undertaking, especially in inclement weather.

Various approaches to providing a visual indication that the mailbox has been opened, or that mail has been deposited in the box, are known in the prior art. Some approaches depend upon the mail carrier to activate the indicator, which is uncertain at best. Other approaches provide an indicator means that is triggered automatically when the door is opened or when mail is placed in the box. Some of these prior art approaches utilize electrical components to illuminate a light, and others use mechanical devices to raise a flag or otherwise signal receipt of mail. Both the electrical and the mechanical devices known in the prior art are relatively complex, and typically are installed in the confined interior of a mailbox. Devices known in the prior art are also relatively costly, and often require frequent adjustment and maintenance.

SUMMARY OF THE INVENTION

The present invention provides a simple, foolproof, inexpensive, and easily installed indicator device to provide a positive and readily visible indication that the mailbox door has been opened. The device requires no action on the part of the mail carrier for activation, and can be very easily reset by the mail customer whenever he or she opens the mailbox door to remove delivered mail or to insert outgoing mail. The device of the invention will not interfere with the operation or position of the outgoing mail flag.

In the preferred embodiment the device of the invention comprises an elongate narrow strip of a flexible, shape-retentive material, such as but not limited to spring steel. At rest, the indicator strip assumes a curved orientation with the general shape of a "C" or "J". One end of the indicator strip is attached to the upper portion of the sidewall or to the top wall, both generally referred to as "upper wall", of a rural-type mailbox (depending upon the configuration of the mailbox) near the rear wall, positioned so that the indicator strip, when flattened against the spring bias of the strip along the upper wall of the mailbox the free end of the strip extends to the edge of the upper wall at the front opening of the mailbox. With the indicator strip held against the upper wall the door of the mailbox is closed and the free end of the indicator strip is confined between the lip of the door and the front edge of the upper wall. When the mailbox door is opened, e.g., by a mail carrier, the free end of the indicator strip is released and the strip returns to its rest position, extending upwardly from its point of attachment to the upper wall of the mailbox, to provide a visual indication that the door of the mailbox has been opened.

The structure and features of the device of the invention will be described in detail with reference to the accompanying drawing figures.

DESCRIPTION OF THE INVENTION

Figure 1:
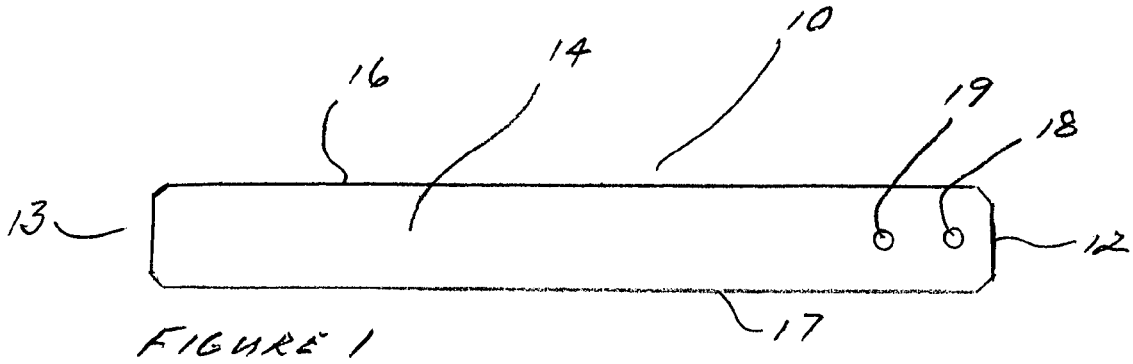
FIG. 1 is a top plan view of a preferred embodiment of the device of the invention, in flattened configuration.
Figure 2:
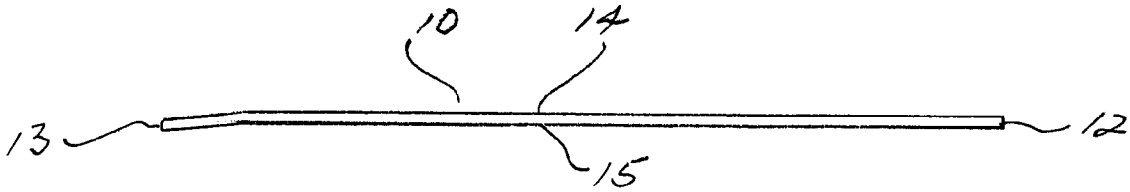
FIG. 2 is a side elevation view of a preferred embodiment of the device of the invention, in flattened configuration.
Figure 3:
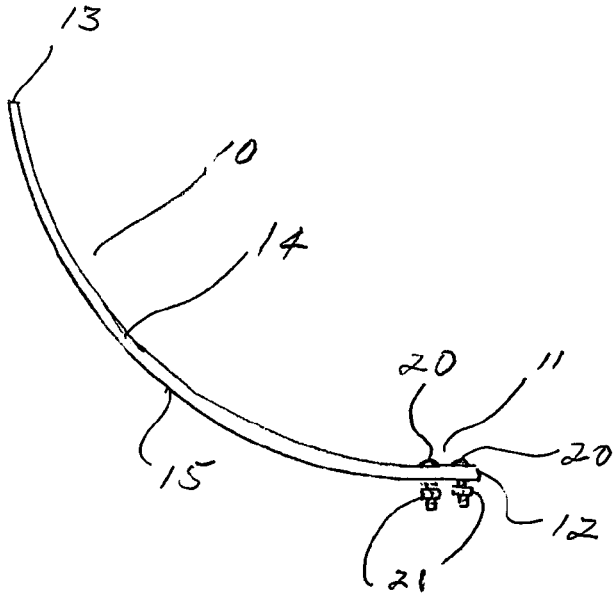
FIG. 3 is a side elevation view of a preferred embodiment of the device of the invention, in curved, or rest, configuration, with fastening bolts and nuts.
Figure 4:
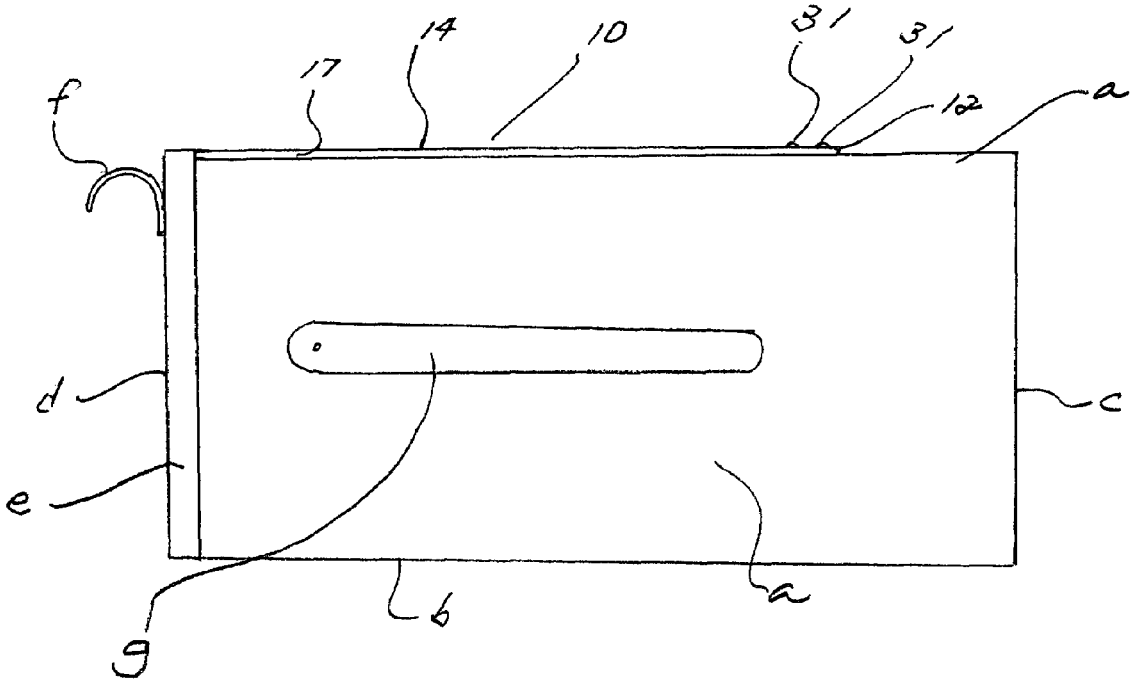
FIG. 4 is a side elevation view of a preferred embodiment of the device of the invention, connected to a mailbox, in set or cocked orientation.
Figure 5:
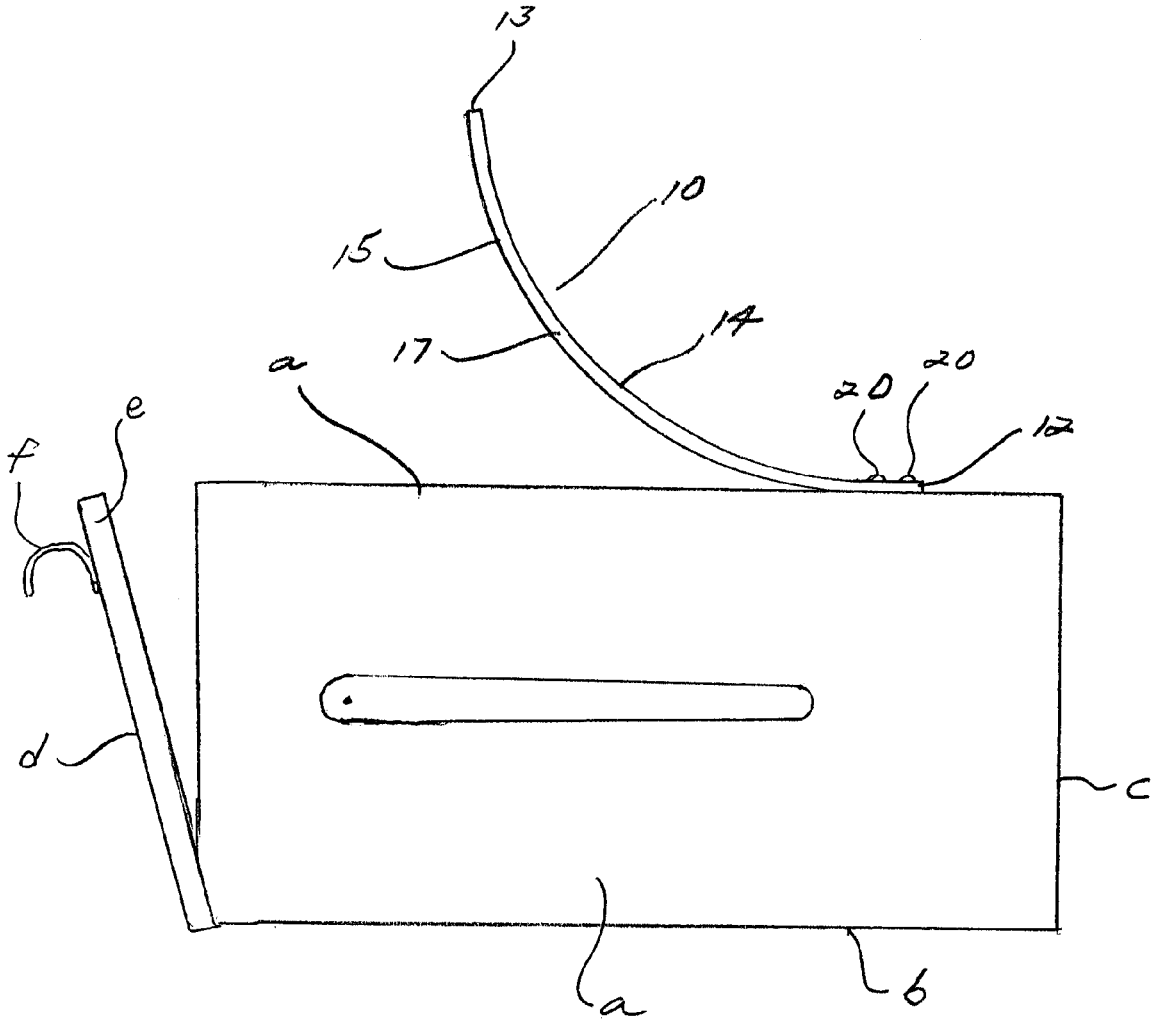
FIG. 5 is a side elevation view of a preferred embodiment of the device of the invention, connected to a mailbox, with the mailbox door opened and with the device indicating the opening of the mailbox door.
Figure 6:
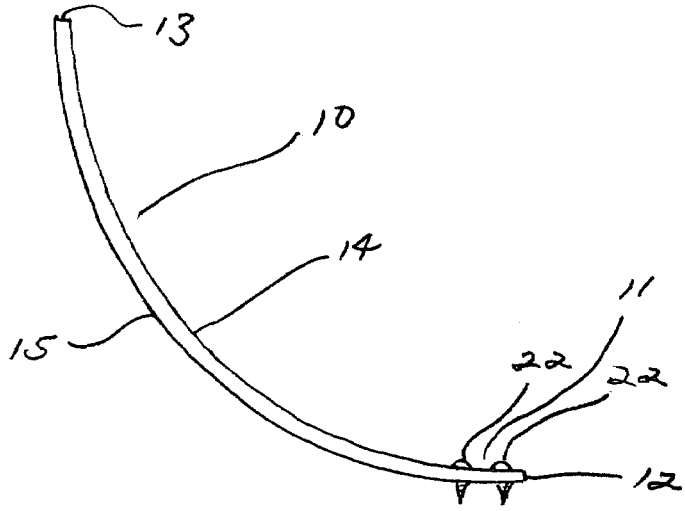
FIG. 6 is a side elevation view of a device of the invention, in curved, or rest, configuration, with an alternative fastening embodiment utilizing screws.
Figure 7:
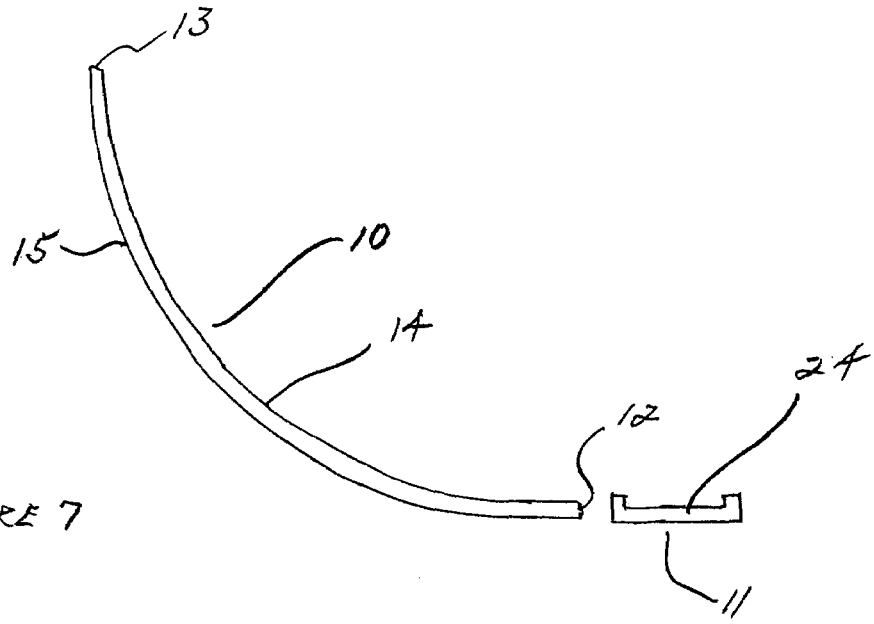
FIG. 7 is a side elevation view of a device of the invention, in curved, or rest configuration, with an alternative mounting bracket fastening embodiment.
Figure 8:
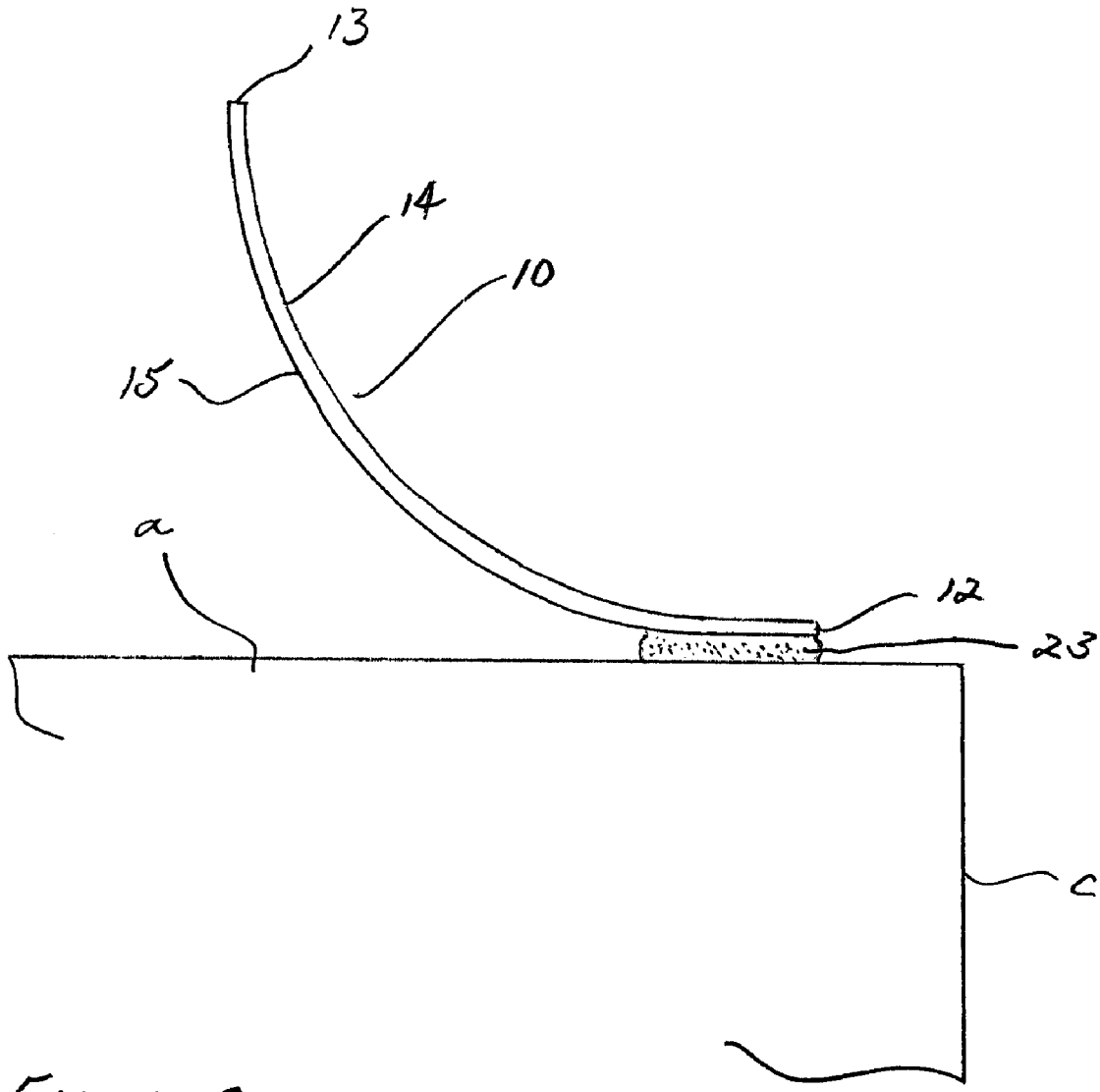
FIG. 8 is a side elevation view of a device of the invention connected to a mailbox (partially shown) utilizing an alternative adhesive fastening embodiment.
Figure 9:
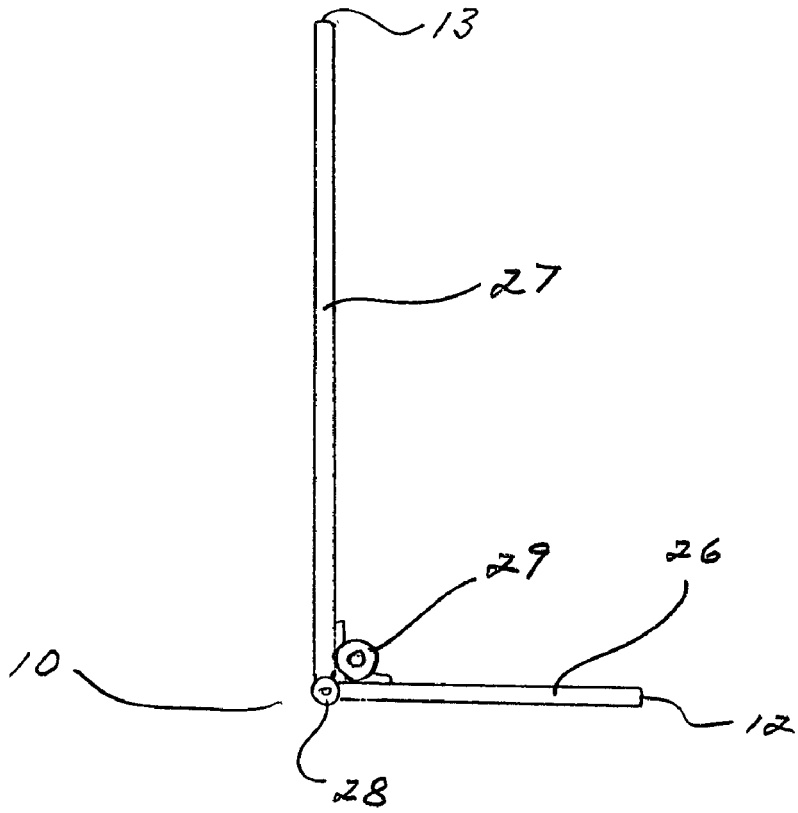
FIG. 9 is a side elevation view of an alternative, two part rigid embodiment of the device, shown in rest configuration.
Figure 10:
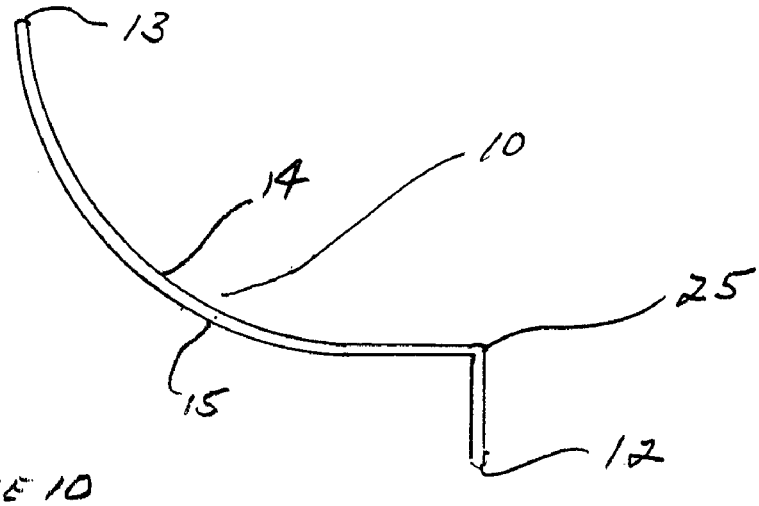
FIG. 10 is a side elevation view of an alternative embodiment of the device, for attachment to the rear wall of a mailbox.
Figure 11:
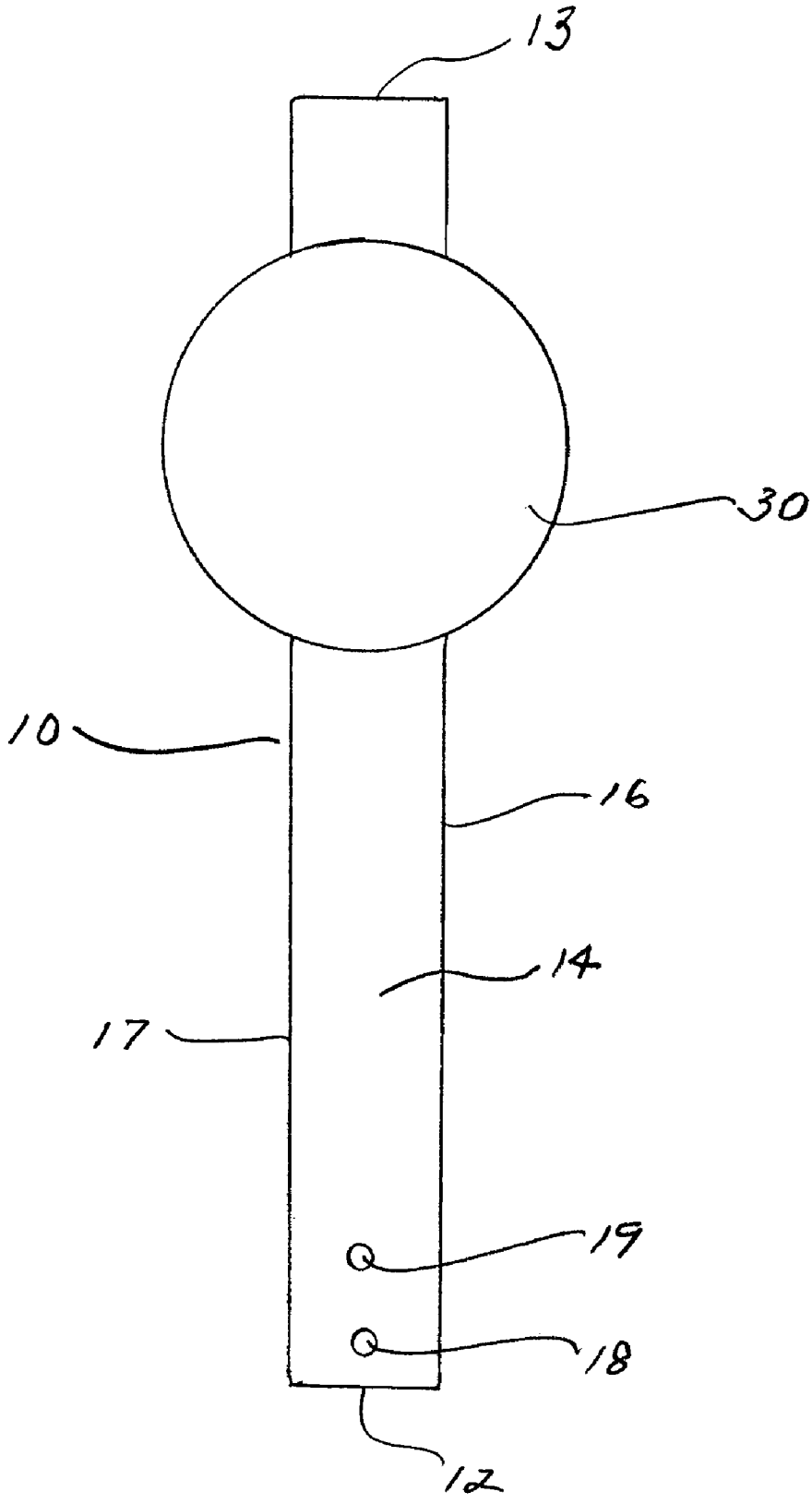
FIG. 11 is a top plan view of an alternative embodiment of the device, in flattened configuration, with a reflector.

In its preferred embodiment, the device of the invention includes an elongate indicator member 10 and a fastening means 11, for attaching indicator 10 to a mailbox. Indicator member 10 is preferably formed as a thin strip of significantly greater length than width, with a first end 12, a second end 13, an upper face 14, a lower face 15 and opposed elongate edges 16 and 17. Indicator 10 is preferably formed of a shape-retentive, flexible material to provide a spring bias to the indicator. A preferred material for indicator 10 is a spring steel, but the scope of the invention is not limited to any particular material, and other shape-retentive flexible materials such as a plastic material with suitable properties may be used if desired. When at rest, indicator 10 has a non-linear, preferably curved and generally C-shaped or J-shaped configuration. Indicator 10 may be deformed from its rest configuration to a generally planar configuration against the spring bias of the material, and when released will return to its rest configuration.

In the preferred embodiment, indicator 10 includes two apertures 18 and 19 adjacent to first end 12 and between elongate edges 16 and 17. Fastening means 11 comprises two bolts 20 which extend through apertures 18 and 19 and are secured by nuts 21 to connect indicator 10 to a mailbox at its first end 12, leaving the remainder of the length of indicator 10 free from permanent connection.

A typical mailbox with which the device of the invention is to be used is, as illustrated in the drawing figures, a hollow box with a sidewall or upper wall "a", formed in an inverted U-shape, a planar bottom closure "b", a rear wall "c", and a door "d" pivotally connected to the bottom closure to close the end of the box opposite rear wall "c". The mailbox door is formed with a lip "e" that extends over a portion of the wall of the mailbox with the door closed, to retain the door in a closed position and help seal the interior of the mailbox. The lip on the mailbox door does not fit tightly against the wall when the door is closed, leaving a small gap between the lip and the wall. A tab "f" is connected to the door to facilitate opening and closing the door. An outgoing mail flag "g" is pivotally connected to the mailbox wall. Although most rural-type mailboxes are configured with a curved or domed sidwall, other configurations, such as square or rectangular, or cylindrical, may be encountered, and the device of the invention may readily be used with such alternative configurations. With a square or rectangular configuration, the mailbox will have a top wall and opposing sidewalls rather than a curved sidewall, and the term "upper wall" in the following description of placement of indicator 10 should be construed as referring to either the upper portion of a curved sidewall or to the top wall, as appropriate to the mailbox with which the device is to be used.

Indicator 10 is attached to a mailbox by first inserting the second end 13 of the indicator strip into the gap between lip "e" and upper wall "a" of the mailbox. Indicator 10 is deformed from its rest position to lie flat against the upper wall of the mailbox, with indicator 10 extending parallel to the longitudinal axis of the mailbox toward rear wall "c". The preferred position for indicator 10 is along the top of the mailbox, at the maximum distance above the bottom closure, for maximum visibility. With the indicator flattened against the upper wall of the mailbox and the first end of the indicator in position for attachment, the position of apertures 18 and 19 is marked on the upper wall of the mailbox and small matching apertures are drilled or punched in the upper wall. The first end 12 of indicator 10 is secured in place on the upper wall of the mailbox by extending bolts 20 through apertures 18 and 19 and the matching apertures formed in the upper wall of the mailbox and securing them with nuts 21. The use of lock washers is preferred, to prevent nuts 21 from loosening, but is not essential.

It is to be understood that although fastener means 11 preferably comprises bolts and nuts 20 and 21, the invention is not limited to any particular fastener means, and other types of fasteners may be readily used. As non-limiting examples, screws 22 may be used instead of bolts 20 and nuts 21, the first end of indicator 10 may be secured to the mailbox by rivets 31 or by a suitable adhesive compound 23, or the indicator may be welded or brazed to the mailbox. A separate mounting bracket 24, which is connected to the mailbox, and into which the first end 12 of indicator 10 is received, may also be used if desired.

After attachment to the mailbox, the indicator is set or cocked by flattening indicator 10 against the upper wall of the mailbox against the spring bias of the indicator, with the mailbox door open, until the second end 13 of the indicator is aligned with the front edge of the upper wall "a" at the mailbox opening. The mailbox door is then closed, with the second end of the indicator confined between the upper wall of the mailbox and the lip "e" of the door, that extends a short distance over the upper wall from the mailbox opening. The indicator will remain in the set or cocked position until the mailbox door is opened.

When the mailbox door is opened, lip "e" is drawn away from the mailbox wall, releasing the second end 13 of the indicator strip. With the second end of the indicator strip no longer retained, the spring bias of indicator 10 causes it to immediately return to its rest position and assume a curved configuration extending upwardly from the mailbox, providing a visual indication that the door of the mailbox has been opened. The door of the mailbox may then be closed, leaving indicator 10 in its rest position to maintain the visual indication until the indicator is reset.

When the postal customer wishes to reset the indicator, e.g., after removing mail from the mailbox, he or she simply presses the indicator strip into a flat configuration along the wall of the mailbox against the spring bias, holds the indicator strip in that configuration, and closes the mailbox door with the second end of the indicator strip between the lip of the door and the wall. The indicator will then remain set until the door is opened again, presumably by a postal carrier in the course of placing mail in the mailbox.

If the postal customer places outgoing mail in the box, he or she may raise the outgoing mail flag and set the indicator of the device of the invention at the same time. There is no contact between the indicator strip and the outgoing mail flag in any configuration, and thus no physical or visual interference between them at any time. The indicator strip moves upward and toward the rear wall of the mail box when it is released by opening the mailbox door, away from a person opening the mailbox from the front or from either side, so it poses no risk of injury to either the mail carrier or the postal customer.

It is preferred that indicator 10 be brightly colored at least on upper face 14, to assure that the indicator is readily visible from a distance when released and in its rest position. Color may be applied by any convenient means, such as by painting or, if the indicator is formed of a plastic material, mixing a pigment into the plastic material used to form the indicator.

In addition to the preferred embodiment described above, the device of the invention is susceptible to variations and alternative embodiments within the scope of the invention. In one alternative embodiment, indicator 10 is formed with a ninety degree bend 25 adjacent to first end 12. In this embodiment indicator 10 is positioned with bend 25 at the intersection between upper wall "a" and rear wall "c" so that the portion of the indicator between bend 25 and first end 12 extends along and is attached to rear wall "c" with the portion of the indicator between bend 25 and second end 13 extending along the upper wall "a" to the front edge as described above.

In another alternative embodiment, indicator 10 is formed in two parts, with a first portion 26 and a second portion 27, connected by a hinge 28. In this alternative embodiment both portions of the indicator are formed of a rigid material without integral spring bias. A separate spring 29, connected between portions 26 and 27 at hinge 28 provides the spring bias to raise the second portion of the indicator when it is released by opening of the mailbox door.

The configuration of indicator 10 is also subject to variation within the scope of the invention without affecting the function of the indicator. Further, visibility enhancing components such as one or more reflectors 30 may be attached to the indicator strip between its first and second ends, if desired, so long as the size and the weight of the reflector(s) does not impede the operation of the indicator.

The foregoing description of the preferred embodiment of the device of the invention, and of some variations and alternative embodiments, is intended to be illustrative and not limiting. The device is susceptible to further alternative embodiments and variations within the scope of the invention and the following claims.

The invention claimed is:

1. A device for visually indicating the opening of a door of a rural mailbox having an upper wall with a front edge, a bottom wall, a rear wall, an open front at the front edge of the upper wall, a longitudinal axis extending through the open front and the rear wall, the openable door having a lip that extends partially over the upper wall with the door in a closed position, comprising, a thin elongate single indicator strip having a first end and a second end distal from said first end, an upper face and a lower face, and opposed side edges, the length of said indicator strip between said first and second ends being substantially greater than the width of said indicator strip between said opposed side edges, said indicator strip being formed in a curved generally C-shaped rest configuration through the substantial majority of the length of said indicator strip of a flexible shape-retentive material with an inherent bias toward said rest configuration such that said indicator strip is deformable from said rest configuration to a flat configuration and will return to said rest configuration when released, said indicator strip to be connected at said first end to the upper wall of the mailbox proximate to the rear wall of the mailbox such that the substantial majority of the length of said indicator strip between said first and second ends extends outwardly in a non-linear curve from the upper wall when in said rest configuration, said indicator strip to be disposed on the upper wall in generally parallel relation to the longitudinal axis of the mailbox such that said second end of said indicator strip is aligned with the front edge of the upper wall with said indicator strip flattened directly against the upper wall against said bias from said rest configuration, such that said second end of said indicator strip is received and retained directly between the upper wall and the lip of the door when the door is closed and released when the door is subsequently opened, allowing said indicator strip to return to said rest configuration of the non-linear curve extending outwardly from the upper wall when the door is opened, thereby providing a visual indication of the opening of the door; and fastening means for connecting said first end of said indicator strip to the upper wall of the mailbox.

2. The device of claim 1, wherein said indicator strip includes an aperture extending through said indicator strip between said upper face and said lower face adjacent to said first end, and wherein said fastening means comprises a bolt to be extended through said aperture and through the upper wall, and a nut to be threaded onto said bolt to connect said indicator strip to the upper wall.

3. The device of claim 1, wherein said indicator strip includes an aperture extending through said indicator strip between said upper face and said lower face adjacent to said first end, and wherein said fastening means comprises a screw to be extended through said aperture and through the upper wall to connect said indicator strip to the upper wall.

4. The device of claim 1, wherein said fastening means comprises an adhesive compound.

5. The device of claim 1, wherein said fastening means comprises a mounting bracket to be connected to the upper wall, and wherein said first end of said indicator strip is connected to said mounting bracket.

6. The device of claim 1, wherein said indicator strip includes an aperture extending through said indicator strip between said upper face and said lower face adjacent to said first end, and wherein said fastening means comprises a rivet to be extended through said aperture and through the upper wall and secured therein to connect said indicator strip to the upper wall.

7. The device of claim 1, wherein said indicator strip is formed of spring steel.

8. The device of claim 1, wherein said indicator strip is formed of plastic.

9. The device of claim 1, wherein said indicator strip is brightly colored so as to enhance the visibility of said indicator strip.

10. The device of claim 1, wherein said indicator strip further includes a reflector disposed on said upper face of said indicator strip between said first and second ends and connected to said indicator strip.

11. A device for providing a visual indication of the opening of a door of a rural mailbox having an open front, an upper wall with a front edge, a rear wall, a longitudinal axis extending through the open front and the rear wall, the openable and closeable door at the open front of the mailbox, the door having a lip extending partially over the upper wall with the door in a closed position, comprising, a thin elongate single piece indicator member with a first end and a second end distal from said first end, said indicator member having an integral bias to a non-linear rest configuration describing a curve extending through the substantial majority of the length of said indicator member, and deformable to a generally linear flattened configuration against said bias, said indicator member to be connected at said first end thereof to the mailbox proximate to the rear wall of the mailbox such that the substantial majority of the length of said indicator member between said first and second ends extends outwardly from the upper wall of the mailbox when in said rest configuration and extends parallel to the longitudinal axis of the mailbox and in direct contact with the upper wall with said second end aligned with the front edge of the upper wall when deformed to said flattened configuration, said second end of said indicator member to be disposed directly between the upper wall and the lip of the door when the door is closed with said indicator member in said flattened configuration, thereby retaining said indicator member in said flattened configuration until the door is opened to release said second end of said indicator member and allow said indicator member to return to said curved rest configuration extending outwardly from the mailbox to provide a visual indication that the door of the mailbox has been opened.

12. The device of claim 11, wherein said indicator member is formed of a flexible, shape-retentive material, wherein said bias is an inherent characteristic of said material, and wherein said non-linear rest configuration is a C-shaped curve.

13. The device of claim 12, wherein said flexible, shape-retentive material is spring steel.

14. The device of claim 12, wherein said flexible, shape-retentive material is plastic.

15. The device of claim 11, wherein said indicator member is connected at said first end to the upper wall of the mailbox at a point on the upper wall maximally separated from the bottom wall of the mailbox.

16. The device of claim 11, wherein said indicator member is formed with a generally right angle bend adjacent to said first end thereof, and wherein said indicator member is connected at said first end to the rear wall of the mailbox with said bend disposed at the intersection of the upper wall of the mailbox with the rear wall of the mailbox.

17. The device of claim 16, wherein said rest configuration of the portion of said indicator member between said second end and said bend is a non-linear curve, and the portion of said indicator member between said first end and said bend is linear.

18. A method of providing a visual indication that a door of a rural mailbox has been opened, the mailbox having an open front, an upper wall with a front edge, a rear wall, a longitudinal axis extending through the open front and the rear wall, and the door for opening a closing the open front, having a lip that extends partially over the upper wall from its front edge when the door is closed, comprising the steps of, providing a thin elongate single indicator member formed of a flexible, shape-retentive material with an inherent bias to a smoothly curved C-shaped rest configuration, said curvature extending through the substantial majority of the length of said indicator member between said first and second ends, said indicator member being deformable from said curved rest configuration to a generally planar configuration against said bias, and said indicator member having a first end and a second end distal from said first end;

connecting said first end of said indicator member to the upper wall of the mailbox proximate to the rear wall, disposed such that the substantial majority of the length of said indicator member in said rest configuration extends outwardly from the upper wall of the mailbox and such that when said indicator member is deformed to said generally planar configuration said indicator member extends along the majority of the length of the upper wall of the mailbox to the front edge of the upper wall in direct contact with the upper wall;

deforming said indicator member against said bias to extend in a generally planar configuration along and in direct contact with the upper wall of the mailbox with said second end of said indicator member aligned with the front edge of the upper wall;

closing the door of the mailbox with said second end of said indicator member disposed directly between the lip of the door and the upper wall, retaining said indicator member in said generally planar configuration against said bias of said indicator member while the door remains closed; and opening the door of the mailbox, withdrawing the lip of the door from the front edge of the upper wall of the mailbox and from said second end of said indicator member, releasing said second end of said indicator member, whereupon said indicator member is urged by said bias to return to said rest configuration, extending outwardly from the upper wall of the mailbox, so as to visually indicate the opening of the door of the mailbox.

* * * * *